US005465502A

United States Patent [19]

Holik et al.

[11] Patent Number: 5,465,502

[45] **Date of Patent: * Nov. 14, 1995**

[54] SUCTION ROLL IN PARTICULAR FOR A PAPER WEB DRYER

[75] Inventors: Herbert Holik, Ravensburg; Werner Leitenberger, Schlier, both of Germany; Reinhard Pinter, Graz, Austria

[73] Assignee: Sulzer-Escher Wyss GmbH, Ravensburg, Germany

[ * ] Notice: The portion of the term of this patent subsequent to Sep. 20, 2011, has been disclaimed.

[21] Appl. No.: 99,026

[22] Filed: Jul. 19, 1993

[30] Foreign Application Priority Data

Jul. 31, 1992 [AT] Austria ..... 1555/92

[51] Int. Cl.[6] ..... D21F 3/10; F26B 13/30

[52] U.S. Cl. ..... 34/115; 34/117; 34/120

[58] Field of Search ..... 34/117, 120, 114, 34/115, 116, 111, 113, 122; 162/363, 366

[56] References Cited

U.S. PATENT DOCUMENTS 5,347,728 9/1994 Pinter et al. ..... 34/115

5,371,954 12/1994 Pinter et al. ..... 34/115

*Primary Examiner*—Denise L. Gromada

*Attorney, Agent, or Firm*—Townsend and Townsend and Crew

[57] ABSTRACT

A suction roll (1), in particular for a paper web dryer, comprising a perforated roll jacket (2), with at least one non-rotatable hollow shaft (3) which communicates with the interior of the suction roll via openings (7, 7') and at least one closing member (9) displaceable in the axial direction for separating off at least one peripheral region of the suction roll. The at least one, in particular disc-shaped dividing wall (5) is located in the suction roll interior and has at least one, preferably central opening (22). It can be of benefit when the dividing wall (5) corotates with the roll and/or when the at least one closing member (9) has the form of a hollow cylinder. Further, if the non-rotatable hollow shaft (3) is designed to be axially displaceable, it can be used to control the size of the opening (22) in the dividing wall (5).

20 Claims, 4 Drawing Sheets

1
2
15
16
7
9
12
14
8'
7'
5
8
3
19
21'
19'
20
24
20
20'
18
17
21
4'
4
13
10
11

Fig. 4
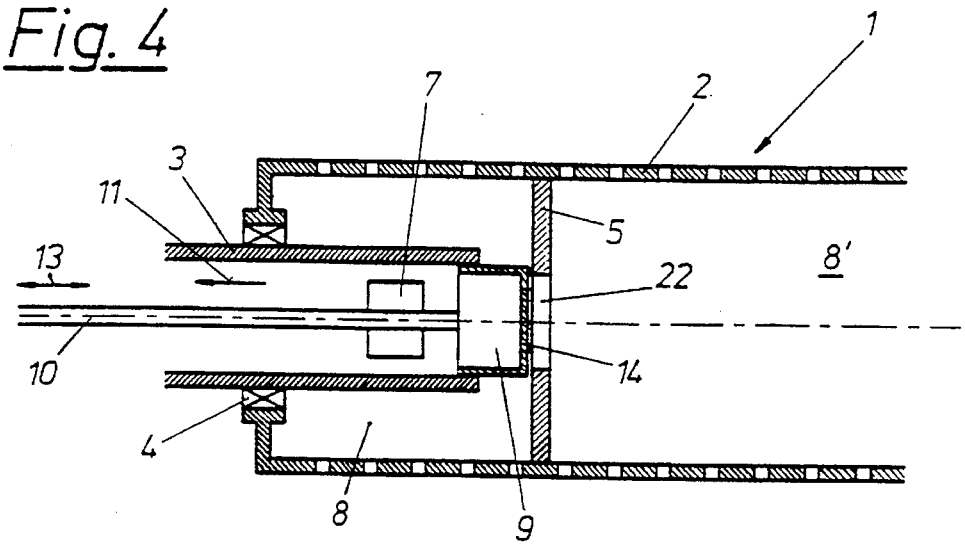
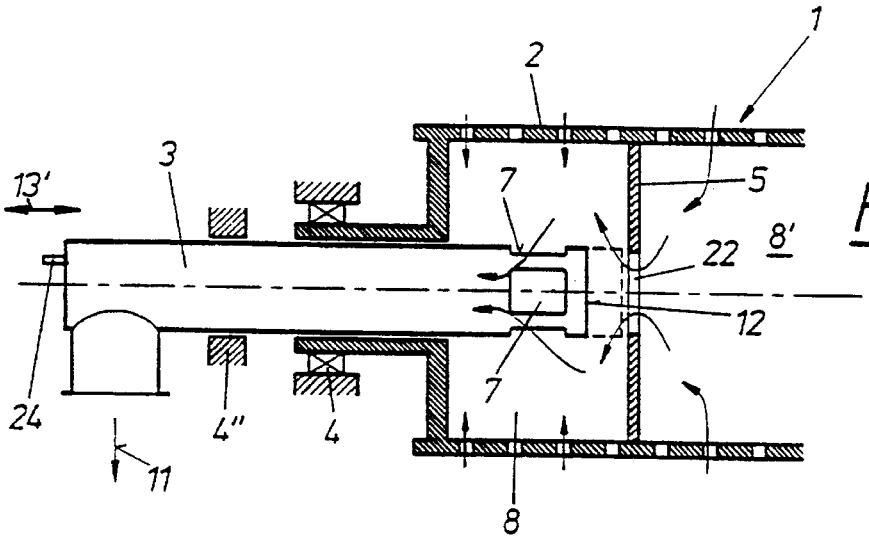
Fig. 5
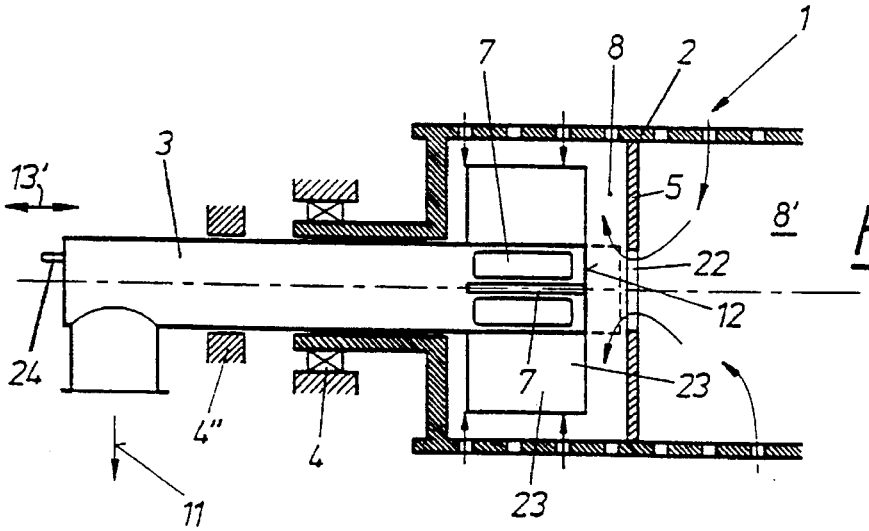
Fig. 8

1
8
7
23
5
2
3
11
13
8'
12
10
4
6
22
9
23'

1
8
7
23
5
2
3
11
13
8'
12'
10
4
6
22
23'
9

SUCTION ROLL IN PARTICULAR FOR A PAPER WEB DRYER

FIELD OF INVENTION

The invention relates to a suction roll, in particular for a paper web dryer, comprising a perforated roll jacket having at least one non-rotatable hollow shaft of circular cross-section which communicates with the interior of the suction roll via openings, and comprising at least one closing member for separating or partitioning off at least one edge region of the suction roll. The hollow shaft is at least blocked against movements in the circumferential direction.

TECHNICAL BACKGROUND

Suction rolls of the initially named kind are described for example in published European patent application 0 428 470 in which the closure member is constructed as a flap and can close the end of a fixed hollow shaft remote from the point of suction.

Such devices have the major disadvantage that a large number of joint connections are necessary in the interior which require corresponding maintenance.

PRINCIPAL OBJECT OF THE INVENTION

It is a principal object of the present invention to avoid such a large number of joint connections in the interior which require maintenance.

BRIEF DESCRIPTION OF THE INVENTION

This is avoided, in accordance with the invention, in that at least one, in particular disk-shaped, dividing wall comprising at least one preferably central opening is provided in the interior of the suction roll and in that the at least one closure member is displaceable in the axial direction. As a result of this, the operational reliability of the suction roll is also considerably increased. In particular, the dividing wall corotates with the roll.

If the closure member is constructed in accordance with the invention as a hollow cylinder, it can be manufactured as a particularly light body and the suction (i.e. pumping away of air) can also be performed through this cylinder without having to tolerate substantial narrowing of the cross-section.

In accordance with a further preferred embodiment of the invention the hollow cylinder inside the hollow shaft is arranged so as to be displaceable. Consequently, exact guidance as well as adjustment and thus also exactly defined suction are possible. It is also advantageous to employ a completely open hollow cylinder in conjunction with a hollow shaft which is closed at the end.

If the hollow shaft is implemented with an open end, then a hollow cylinder is preferably provided in accordance with the invention with a closed cover at at least the end facing away from the point of suction out of the suction roll. The central region of the suction roll can thereby be partitioned off from the edge region.

A variant of the invention is characterized in that the openings in the fixed hollow shaft arranged in the central region of the suction roll are controllable with regard to their transmission cross-section via the at least one closing member displaceable in the axial direction. The entire suction power can be concentrated on the edge region by closing the opening in the central region of the suction roll. This is particularly preferred during the start up phase. Such types of devices can also be advantageously employed for material webs, in particular paper webs, which tend to shrink or arch up at their edges.

A particularly preferred embodiment of the invention is characterized in that the hollow cylinder displaceable in the axial direction serves as the closure for the central opening of the corotating dividing wall. This variant has the advantage that no parts are necessary which protrude into the central region of the suction roll. Suction rolls in accordance with the invention are particularly favorable with regard to manufacture and usage when the non-rotatable hollow shaft containing the axially displaceable closing member is constructed so as to be cylindrical and of constant diameter, at least inside the suction roll.

A further embodiment of the invention is characterized in that at least one, in particular disk-shaped, dividing wall is provided in the interior of the suction roll which corotates with the roll and which has at least one, preferably central, opening; and in that the non-rotatable hollow shaft is constructed so as to be axially displaceable and serves as the closure member controlling the transmission cross-section of the opening in the dividing wall which corotates with the roll. A further embodiment in accordance with the invention which is a modification consists of the hollow shaft being closed at its end facing away from the point of suction. It is particularly preferred if the hollow shaft, when in its end position, closes the preferably central opening in the corotating dividing disk. Such an embodiment makes a short construction of the hollow shaft possible and thereby a greater stability as well as exact guidance. A partitioning off of the edge zone can be achieved very easily as a result of the closed end, and is further improved due to the fact that the hollow shaft closes the central opening in the dividing disk when in its end position.

A solution in accordance with the invention which is particularly simple is achieved when the non-rotatable hollow shaft constructed as a closing member displaceable in the axial direction is constructed so as to be cylindrical and of constant diameter, at least within the suction roll.

A further variant of the invention is characterized in that two edge regions which can be partitioned off are provided and comprise corotating dividing walls having openings and closing members displaceable in the axial direction provided for the openings, the edge regions each being connected to the suction apparatus. Consequently, as well as being able to regulate during start up, the suction in the edge regions can be regulated separately which is particularly advantageous especially when shrinkage at the edges of the paper web occurs and for preventing web fluttering. The integration of the suction roll in accordance with the invention into a paper web dryer is preferably characterized in that the displacing devices for the closing members are connected to a control in particular to the central control of the paper web dryer. This makes a highly beneficial automatization of both the start up and the subsequent switching to normal operation possible, so that this can be carried out centrally by a control operator.

A further embodiment in accordance with the invention is characterized in that a pressure measurement point is provided on the hollow shaft, which is in particular axially displaceable, and is connected to a control system in particular the central control system of the paper web dryer. With such a pressure measurement point mounted in accordance with the invention it is easy to establish whether paper is running over the roll. This is possible during both the start up phase and normal operation. If the pressure measurement point is connected to the central regulation system then other units of the paper web dryer, such as the so-called Couchman, can be controlled using the pressure measurement point signal, since tears in the paper can in particular be easily recognized.

A further favorable embodiment of the invention is characterized in that vanes are mounted on the circumference of the hollow shaft. This leads to a reduction or prevention of vortices and, as a result of the reduced pressure losses, to a corresponding energy saving for the suction process.

BRIEF DESCRIPTION OF THE DRAWINGS

The invention will now be described in more detail with the aid of drawings, wherein:

FIG. 4 shows a variant of the invention comprising a hollow cylinder, FIG. 5 shows a variant of the invention comprising a displaceable hollow shaft; and FIGS. 6, 7, and 8 show variants of the invention in accordance with FIGS. 1, 2 and 5 comprising vanes disposed at the circumference in each case in partial axial section.

DESCRIPTION OF PREFERRED EMBODIMENTS

Figure 1:
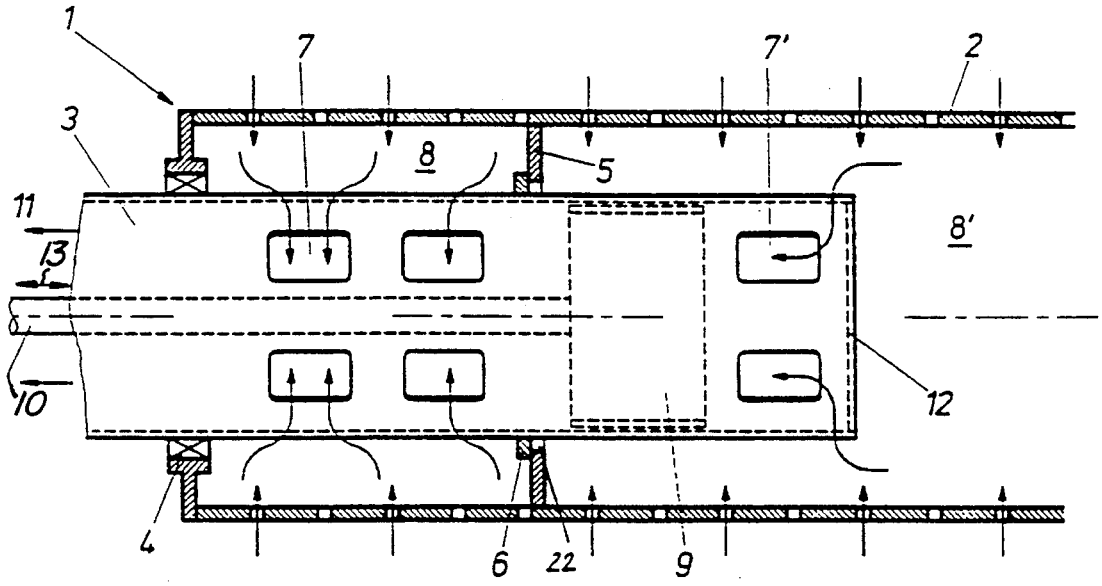
FIG. 1 shows a first embodiment of the invention.

In FIG. 1, a first variant of the suction roll in accordance with the invention is shown. The suction roll 1 has a perforated suction roll jacket 2. The roll 1 is, in this example, journalled by a bearing 4 disposed at the circumference of the hollow shaft 3. Separating disks 5 having a central opening 22 are fixedly connected to the inner circumference of the suction roll jacket 2 and are provided in order to subdivide the interior volume of the suction roll 1. These disks are connected to a sealing ring 6 mounted on the outer circumference of the hollow shaft 3. The inside of the hollow shaft 3 communicates with the edge region 8 of the suction roll 1 via openings 7 and with its central region 8' via openings 7'. The air sucked out through the perforated roll jacket 2 is then sucked through the openings 7, 7' into the hollow shaft 3 and from there onward in the direction of the arrow 11. Thus air from the peripheral region of the roll at the edge region 8 passes through the apertures 7, whereas air from the central peripheral region of the roll at the central region 8 passes through the apertures 7'.

Figure 2:
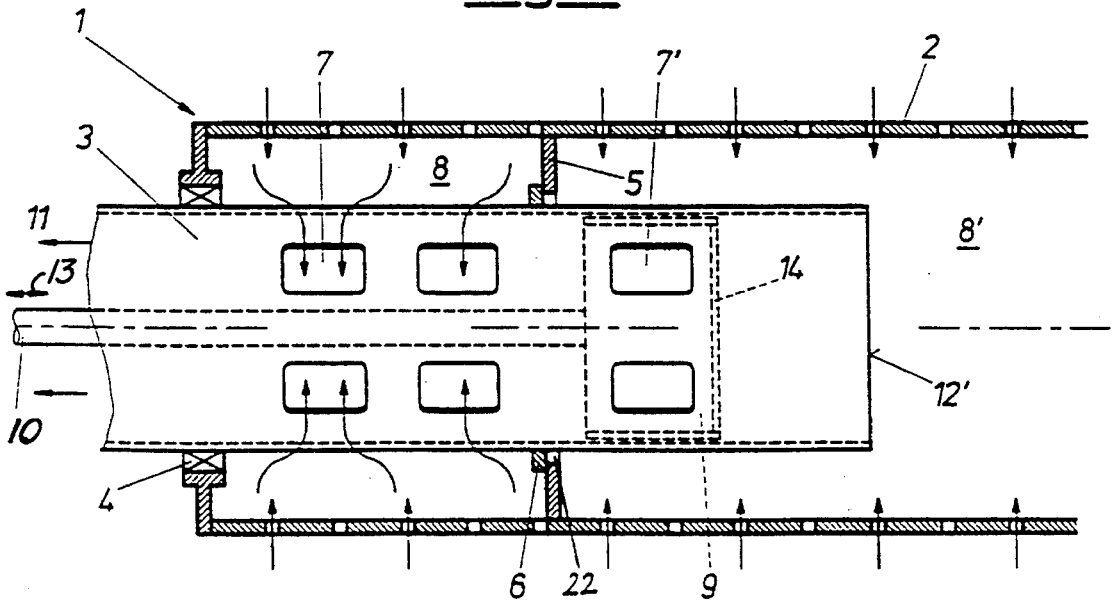
FIG. 2 shows a second embodiment of the invention.

For separation or partitioning of the edge region 8 from the central region 8', the open hollow cylinder 9 is now shifted by means of a shiftable bar 10 in the direction of the closed end 12 of the hollow shaft 3. The openings 7' are thus closed and sucking out is now only possible via the openings 7. In order to control the suction, the hollow cylinder 9 can be shifted in the direction of the arrow 13. Depending on the position of the opening 7' in the central part 2', the open position can result from a translation of the hollow cylinder 9 either in the direction towards the edge of the suction roll 1 (as shown in FIG. 1) or in the direction towards the middle of the suction roll 1. FIG. 2 shows a further variant for which the same reference numerals are used for the same parts. A hollow shaft 3 with an open end 12' is used here. The hollow cylinder 9 is thus closed by a lid or cover 14 which is mounted on one of the two end faces of the hollow cylinder 9. It operates similarly to the embodiment shown in FIG. 1 except for the fact that the open and closed positions are interchanged. In principle, the end wall 12' of the hollow shaft 3 and the end wall of the hollow cylinder 9 could be closed with a lid 14. In these variants, the hollow shaft 3 is constructed as a cylindrical pipe having a diameter which remains constant and which extends right through the bearing. This has the advantage over embodiments in which the diameter increases in the interior of the suction roll 1 that no slopes or steps are present at which air vortices could form which could then lead to undesirable pressure losses. Furthermore, the hollow shaft 3 together with the closing member 9 is then easy to assemble and disassemble.

Figure 3:
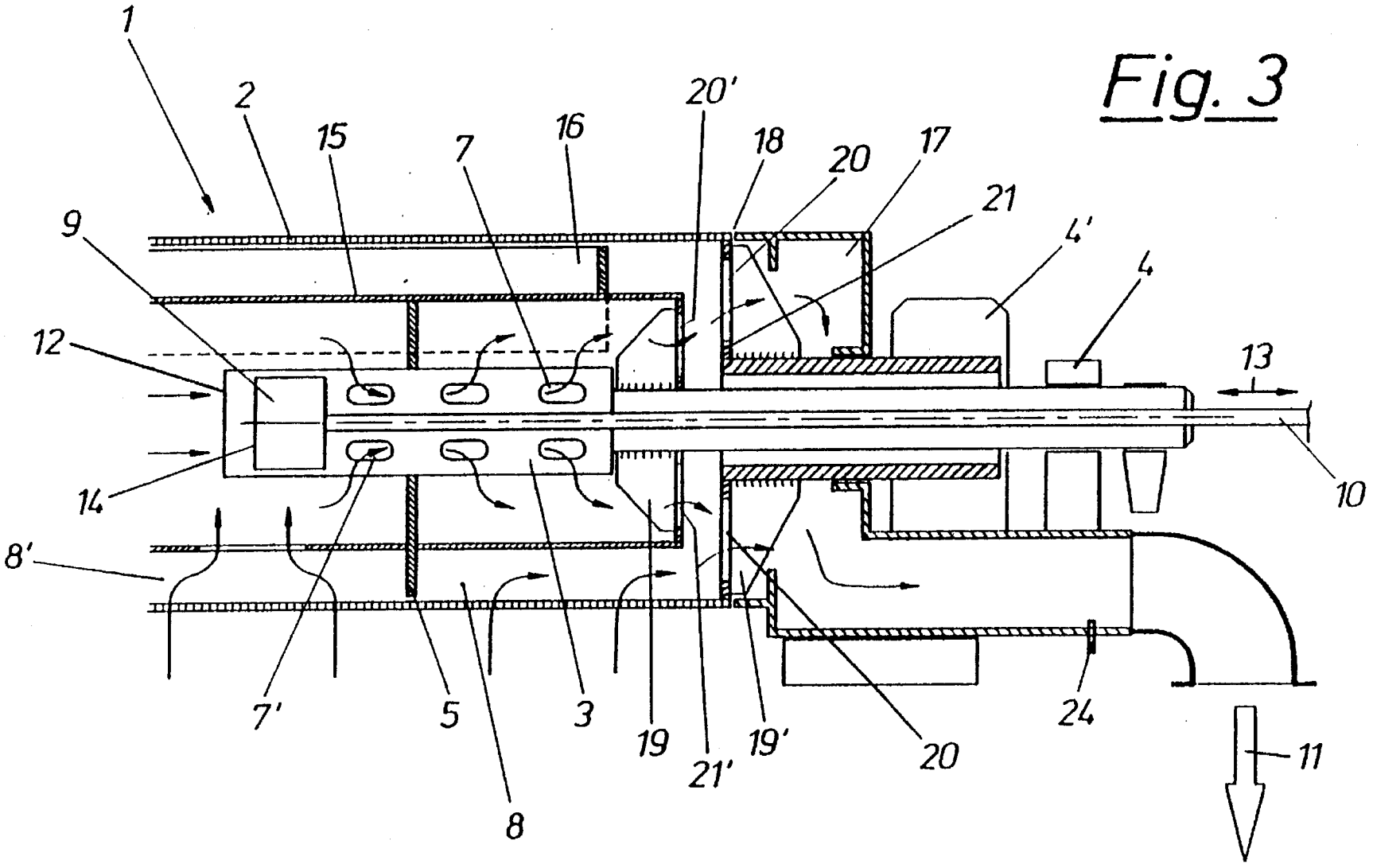
FIG. 3 shows a further embodiment of the invention comprising a hollow cylinder.

The variant in FIG. 3, as well as having the hollow shaft 3, has a further outer hollow shaft 15 which extends concentrically around the hollow shaft 3. Furthermore, the outer hollow shaft 15 can extend over the entire length of the suction roll 1. The outer hollow shaft 15 is provided with axially parallel sealing strips 16 which separate off the circumference of the suction roll 1 not contacting the paper from the suction. This hollow shaft 15 is journalled rotatably or pivotably in the bearing 4' in order to be able to adjust the region not experiencing suction according to the operational parameters. In this case, the suction takes place through a fixed suction volume 17 which is sealed relative to or against the rotating suction roll 1 by a seal 18. For better guidance of the air streams, vanes 19, 19' are connected to the lid 21 of the suction roll 1 and the lid 21 of the outer hollow shaft 15 respectively. The suction takes place through openings 20 and 20' in the lids 21 and 21' respectively. For the control of the paper web dryer especially when tears in the paper web occur, a pressure measurement point 24 can also be mounted, for instance in the suction channel of the suction volume 17. Moreover, in FIG. 3 the possibility of suction in the other direction is shown, although this is not mandatory.

A further embodiment of the invention is shown in FIG. 4. In this case, the hollow shaft 3 extends only in the edge region 8 of the suction roll 1. This region 8 is, in turn, separated off from the central region 8' by means of a dividing disk 5 corotating with the perforated roll jacket 2. During start up, the hollow cylinder 9 with its closed lid 14 is pressed against the dividing disk 5 by the shiftable bar 10. The opening 22 to the central region 8' is thereby closed and air is subsequently sucked out of the edge region 8 and passes through the openings 7 of the hollow shaft 3 in the direction of the arrow 11. In the open state, the air from the central region 8' of the suction roll 1 is sucked out through the opening 22 of the dividing disk 5 and onward through the openings 7 of the hollow shaft 3.

A further variant is shown in FIG. 5. Here, the hollow shaft 3 is itself constructed as the closure member. The hollow shaft is displaced in the direction of the arrow 13' for separating off the edge region 8 from the central region 8' of the suction roll and, when in its end position, closes the opening 22 of the dividing disk 5 with the end 12. The hollow shaft 3 is displaceably journalled in the bearing 4" in order to improve the displaceability. This variant has the major advantage of a simple construction and of a short displacement path. The suction connection of the hollow shaft 3 can be easily implemented using flexible tubing. A pressure measurement point 24 can also be mounted here, for instance in the cover of the hollow shaft 3, in order to control the paper web dryer. In an embodiment provided with two suction systems, the pressure measurement point can be mounted at any desired side. In principle, it is also possible to locate the pressure measurement point 24 in the adjoining fixed conduit. The nearer the pressure measurement point 24 is to the suction roll 1, the clearer is the pressure signal.

In the variants of FIGS. 4 and 5, the hollow shaft 3 is also constructed as a cylindrical tube with a diameter which remains constant, in order to avoid undesired turbulence of the air being sucked away and also to avoid unnecessary deflections of the air stream.

Figure 6:
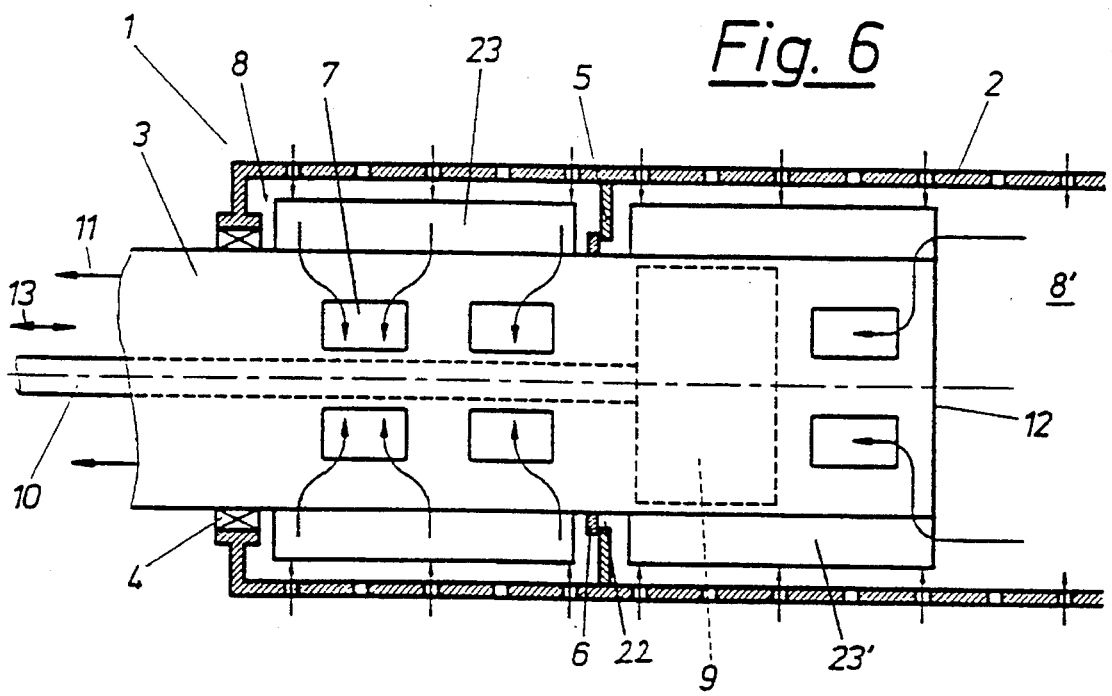
Figure 7:
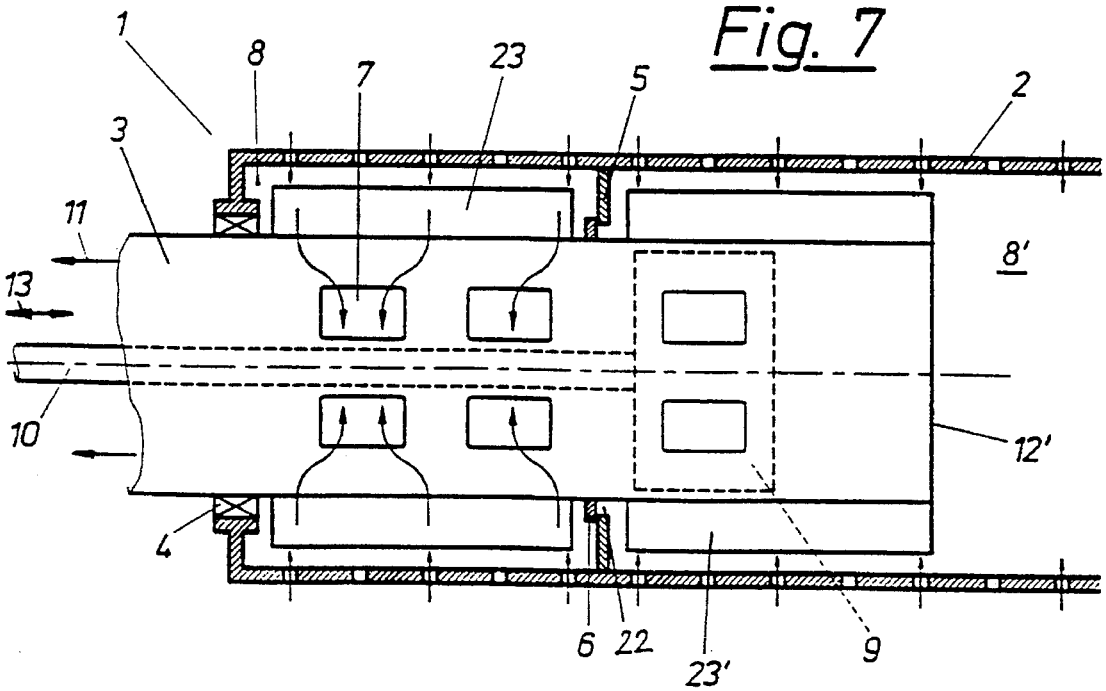

The embodiments of FIGS. 6 and 7 correspond to those of FIGS. 1 and 2, however vanes 23, 23' are provided at the circumference of the hollow shaft 3 in order to reduce or completely prevent miscellaneously occurring vortices. For this, on the one hand, vanes 23 could be provided in the edge region 8 or, on the other hand, vanes 23' could be provided in the central region 8'. If need be, these embodiments could also be combined. The variant in FIG. 8 corresponds to that of FIG. 5, wherein once more additional vanes 23 are provided for the reduction or prevention of miscellaneous vortices.

The embodiments of the invention shown in FIGS. 1 and 8 could also be provided at the other end of the suction roll or also symmetrically in order to achieve a control for the purpose of hindering the shrinkage of material webs, for instance paper webs, or also for the prevention of web fluttering in addition to the special control during start-up.

The invention not only includes those variants shown in the drawings, but also all other embodiments envisaged by the claims, in which at least one, in particular disk-shaped dividing wall corotating with the roll and having a preferably central opening is provided in the interior of suction roll and in which the through-flow cross-section of the opening is controllable by means of a closure member displaceable in the axial direction, and in which the at least one closure member is preferably constructed as a hollow cylinder.

What is claimed is:

1. Suction roll for a paper web dryer, comprising a perforated roll jacket, at least one non-rotatable hollow shaft of circular cross-section communicating with an interior of the suction roll via openings, at least one closure member for partitioning off at least-one edge region of the suction roll and being displaceable in the axial direction, and at least one disk-shaped, dividing wall comprising at least one central opening located in the interior of the suction roll.

2. Suction roll as set forth in claim 1, wherein the dividing wall corotates with the roll.

3. Suction roll as set forth in claim 1, wherein the at least one closure member is a hollow cylinder.

4. Suction roll as set forth in claim 3, wherein the hollow cylinder is displaceably arranged inside the hollow shaft.

5. Suction roll as set forth in claim 3, wherein the hollow cylinder has a closed cover at least at an end facing away from a point of suction out of the suction roll.

6. Suction roll as set forth in claim 1, including a fixed hollow shaft arranged in a central region of the suction roll and having openings cross-sections of which are controllable with the at least one closure member displaceable in the axial direction.

7. Suction roll as set forth in claim 2, wherein the hollow closure member is displaceable in the axial direction and is adapted to close the central opening of the corotating dividing wall.

8. Suction roll as set forth in claim 1, wherein the non-rotatable hollow shaft is cylindrical and of constant diameter at least along the interior of the suction roll and the closure member is disposed in the hollow shaft.

9. Suction roll for a paper web dryer comprising a perforated roll jacket having at least one non-rotatable hollow shaft of circular cross-section which communicates with an interior of a suction roll via openings, at least one closure member for partitioning off at least one edge region of the suction roll, at least one disk-shaped dividing wall in the interior of the suction roll which corotates with the roll and which comprises at least one central opening, the non-rotatable hollow shaft being constructed to be axially displaceable and serving as the closure member controlling a through flow cross-section of the central opening in the dividing wall.

10. Suction roll as set forth in claim 9, wherein the hollow shaft is closed at its end remote from a point of suction.

11. Suction roll as set forth in claim 10, wherein the hollow shaft in its end position closes the central opening in the corotating dividing wall.

12. Suction roll as set forth in claim 9, wherein the non-rotatable hollow shaft constructed as a closure member displaceable in the axial direction is cylindrical and of constant diameter at least along the suction roll.

13. Suction roll as set forth in claim 1, wherein two edge regions can be partitioned off and are adapted to be connected to suction apparatus, and including corotating dividing walls having openings and closure members therefor which are displaceable in the axial direction.

14. Suction roll as set forth in claim 9, wherein two edge regions can be partitioned off and are adapted to be connected to suction apparatus, and including corotating dividing walls having openings and closure members therefor which are displaceable in the axial direction.

15. Suction roll as set forth in claim 1, including a displacing device for the closure members connected to a central control for the paper web dryer.

16. Suction roll as set forth in claim 9, including a central control for the paper web dryer and a displacing device for the closure member connected to the central control.

17. Suction roll as set forth in claim 1, including a central control for the paper web dryer and a pressure measurement point at the hollow shaft which is axially displaceable, the pressure measurement point being connected to the central control.

18. Suction roll as set forth in claim 9, including a central control for the paper web dryer and a pressure measurement point at the hollow shaft which is axially displaceable, the pressure measurement point being connected to the central control.

19. Suction roll as set forth in claim 1, including vanes mounted on a circumference of the hollow shaft.

20. Suction roll as set forth in claim 9, including vanes mounted on a circumference of the hollow shaft.

* * * * *

UNITED STATES PATENT AND TRADEMARK OFFICE

CERTIFICATE OF CORRECTION

PATENT NO. : 5,465,502
DATED : November 14, 1995
INVENTOR(S) : Herbert Holik, et al.

It is certified that error appears in the above-indentified patent and that said Letters Patent is hereby corrected as shown below:

On the title page, after item [22] filed: please change "Jul. 19, 1993 to --Jul. 29, 1993 --.

Signed and Sealed this

Thirteenth Day of August, 1996

*Attest:*

BRUCE LEHMAN

*Attesting Officer*

*Commissioner of Patents and Trademarks*